US005697510A

United States Patent [19]

Wang et al.

[11] Patent Number: 5,697,510

[45] Date of Patent: Dec. 16, 1997

[54] CONTAINER AND VALVED CLOSURE

[76] Inventors: Jui-Te Wang, No. 23-45, Lane 940, Chung Cheng Rd., Wu Fong Hsiang, Taichung Hsien; Ching-Lieh Wu, No. 2, Alley 11, Ta Ming Lane, Sec. 1, Chung Hsin Rd., Ta Li Hsiang, Taichung Hsien, both of Taiwan

[21] Appl. No.: 648,362

[22] Filed: May 14, 1996

[51] Int. Cl.[6] ..... B65D 51/16

[52] U.S. Cl. ..... 215/262; 215/307; 215/310; 215/902; 220/231; 220/367.1; 251/322; 251/323

[58] Field of Search ..... 215/307, 310, 215/262, 902; 220/231, 79.6, 361, 367.1, 368, 373; 251/321-323

[56] References Cited

U.S. PATENT DOCUMENTS 1,156,915 10/1915 Mazoyer ..... 215/307 X 3,167,202 1/1965 Tolciss ..... 215/307

4,905,863 3/1990 Blomquist et al. ..... 220/231

5,397,024 3/1995 Wu et al. ..... 220/361 X

*Primary Examiner*—Allan N. Shoap

*Assistant Examiner*—Robin A. Hylton

*Attorney, Agent, or Firm*—Charles E. Baxley, Esq.

[57] ABSTRACT

A container includes a cover engaged on an open top. A channel and an opening are formed in the cover. A knob is slidably engaged in the channel and includes a tube having a pair of shoulders. A plug has a pair of hooks engaged into the tube and engaged with the shoulders so as to secure the plug to the tube. A spring is biased between the knob and the plug for biasing the knob partially outward of the cover and for forcing the plug against the cover to enclose the orifice. The plug can be made of plastic material instead of metal material.

2 Claims, 4 Drawing Sheets

CONTAINER AND VALVED CLOSURE

BACKGROUND OF THE INVENTION

1. Field of the Invention

The present invention relates to a cover, and more particularly to a cover for a container.

2. Description of the Prior Art

The closest prior art of which applicants are aware is their prior U.S. Pat. No. 5,397,024 to Wu et al. The cover includes a valve depressible inward of the cover for allowing air to flow inward or outward of the cover. However, the valve assembly includes a screw secured to the plug rod and engaged with the cover for preventing the valve assembly from disengaging from the cover. The screw is normally made of metal and may not be easily threaded into place. In addition, the screw which is made of metal material may not closely enclose the opening of the cover such that a rubber ring and a gasket are required to be engaged on the screw for engaging with the cover so as to enclose the opening. Furthermore, the inner thread of the plug rod may be easily damaged by the metal screw.

The present invention has arisen to mitigate and/or obviate the afore-described disadvantages of the conventional covers for containers.

SUMMARY OF THE INVENTION

The primary objective of the present invention is to provide a cover of a container which includes no screw therein.

In accordance with one aspect of the invention, there is provided a container comprising a container body including an open top, a cover engaged on top of the container body for enclosing the open top of the container body, the cover including a channel formed therein and including an opening formed therein and communicating with the channel, a knob slidably engaged in the channel and including a tube extended therefrom and having a pair of engaging shoulders formed therein, the knob including at least one projection for engaging with the cover so as to prevent the knob from engaging into the channel, a plug including a pair of hooks extended therefrom and a slit formed between the hooks, the hooks being engaged into the tube and engaged with the engaging shoulders of the tube so as to allow the plug to be secured to the tube, and a biasing means biased between the knob and the plug for biasing the knob partially outward of the cover and for forcing the plug against the cover and for enclosing the orifice.

The knob includes at least one spring leg extended therefrom for engaging with the cover so as to form the biasing means.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
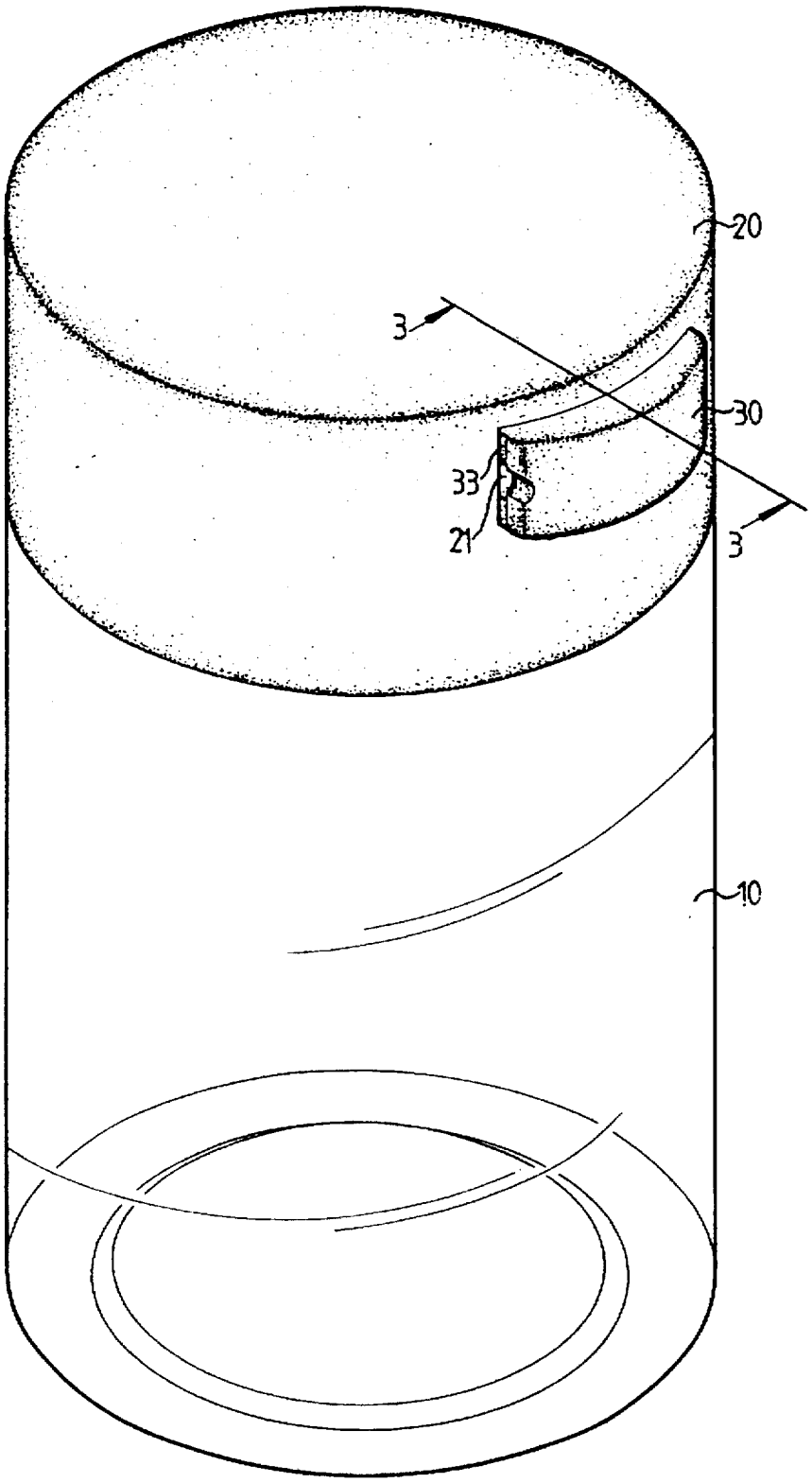
FIG. 1 is a perspective view of a container in accordance with the present invention.

Referring to the drawings, and initially to FIGS. 1 to 4, a container in accordance with the present invention comprises a container body 10 including an open top 11. A cover 20 is engaged on top of the container body 10 for enclosing the open top of the container body 10. The cover 20 includes a channel 21 formed therein and includes an opening 211 formed therein and communicating with the channel 21. A knob 30 is slidably engaged in the channel 21 and includes a tube 31 extended therefrom and having a pair of engaging shoulders 311 formed therein. The knob 30 includes four projections 33 for engaging with the cover 20 so as to prevent the knob 30 from engaging into the channel 21 of the cover 20.

A plug 40 includes a pair of hooks 41 engaged into the tube 31 of the knob 30 and for engaging with the engaging shoulders 311 of the tube 31 so as to allow the plug 40 to be quickly secured to the tube 31 of the knob 30. The plug 40 includes a slit 411 formed between the hooks 41 so as to increase the resilience of the hooks 41. A coil spring 35 is engaged on the tube 31 and is biased between the knob 30 and the plug 40 so as to bias the knob 30 partially outward of the cover 20 and so as to force the plug 40 against the cover 20 for enclosing the orifice 211, best shown in FIG. 3.

Figure 4:
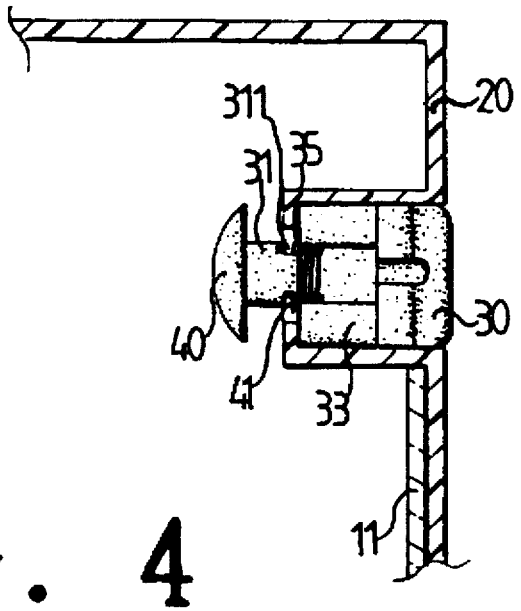

In operation, as shown in FIG. 4, when the knob 30 is depressed inward of the channel 21, the plug 40 is disengaged from the opening 211 such that the opening 211 is opened and such that air is allowed to flow inward or flow outward of the cover.

It is to be noted that the plug 40 can be easily made by molding processes and can be made with plastic materials instead of metal material that is used for making the typical fastening screw. In addition, the plug 40 can be easily and quickly secured to the knob 30 by engaging the hooks 41 into the tube 31 of the knob 30. Furthermore, the plug 40 itself is good enough to be used for closely enclosing the opening 211.

Figure 2:
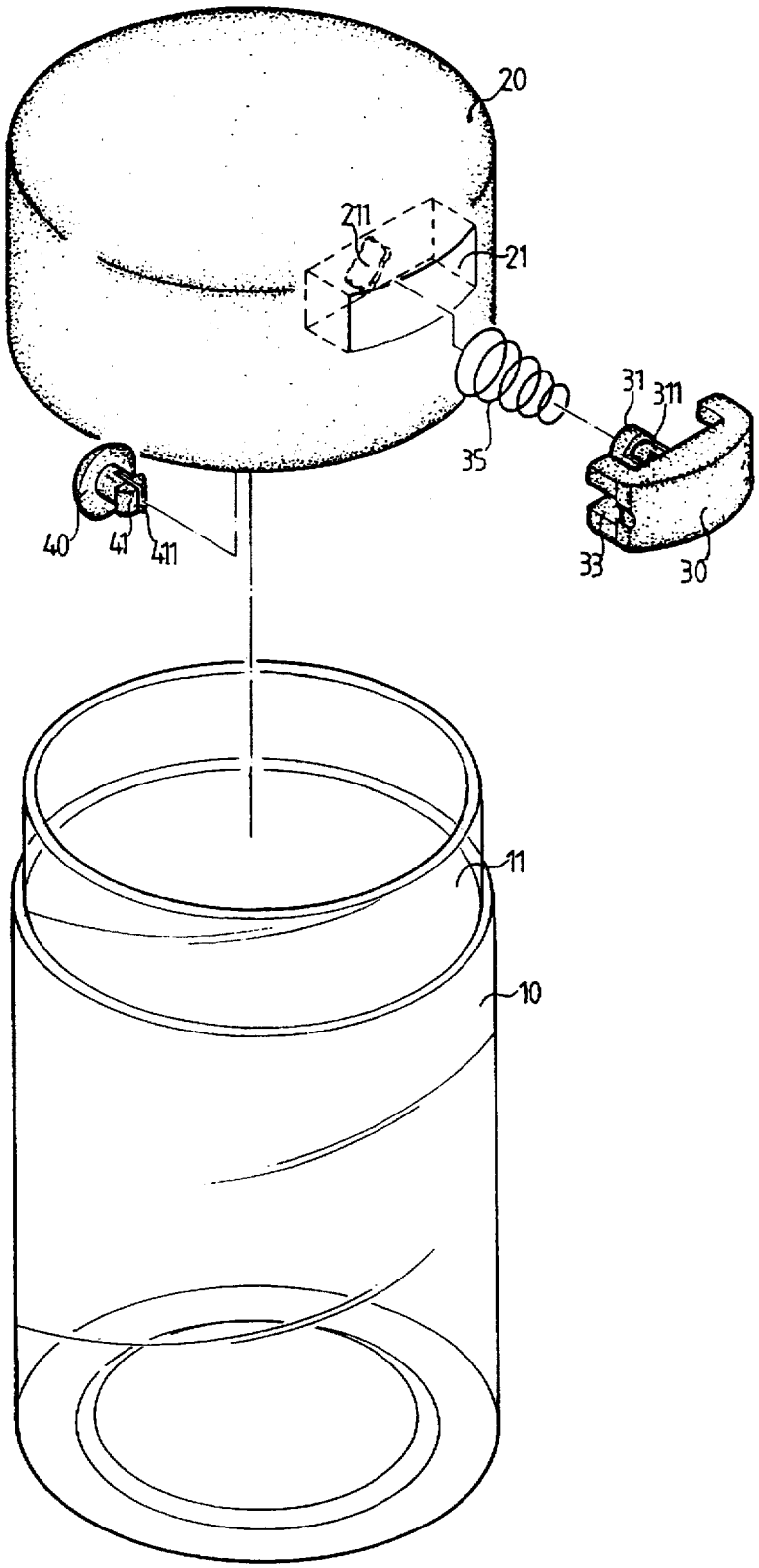
FIG. 2 is an exploded view of the container.
Figure 3:
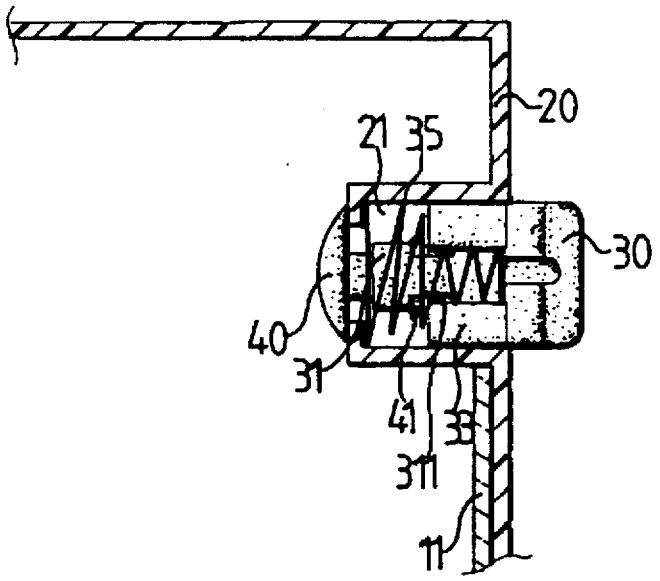
FIGS. 3 and 4 are cross sectional views taken along lines 3—3 of FIG. 1.
Figure 5:
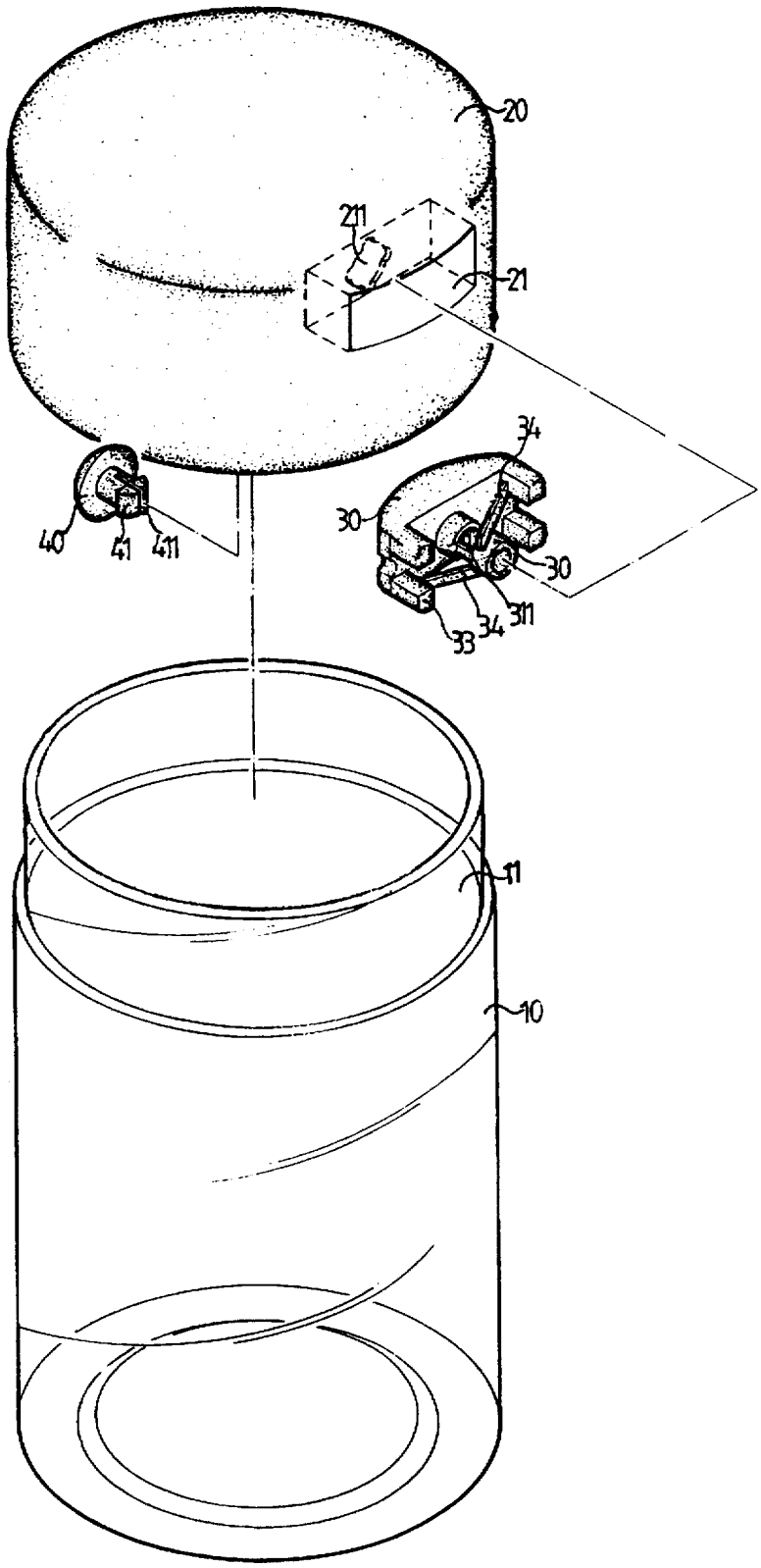
FIG. 5 is an exploded view illustrating another application of the container.

Referring next to FIG. 5, instead of the spring 35 as shown in FIGS. 2 to 4, the knob 30 includes a pair of spring legs 34 for engaging with the cover 20 so as to bias the knob 30 partially outward of the cover 20 and so as to force the plug 40 against the cover 20 for enclosing the orifice 211.

Accordingly, the container in accordance with the present invention includes a plug that may be easily and quickly secured to the knob and that may be effectively used for enclosing the opening of the cover.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A container comprising:

a container body including an open top, a cover engaged on top of said container body for enclosing said open top of said container body, said cover including a channel formed therein and including an opening formed therein and communicating with said channel, a knob slidably engaged in said channel and including a tube extended therefrom and having a pair of engaging shoulders formed therein, said knob including at least one projection for engaging with said cover so as to prevent said knob from engaging into said channel, a plug including a pair of hooks extended therefrom and a slit formed between said hooks, said hooks being engaged into said tube and engaged with said engaging shoulders of said tube so as to allow said plug to be secured to said tube, and a biasing means biased between said knob and said plug for biasing said knob partially outward of said cover and for forcing said plug against said cover and for enclosing said opening.

2. A container according to claim 1, wherein said knob includes at least one spring leg extended therefrom for engaging with said cover so as to form said biasing means.

* * * * *